US009623989B2

(12) United States Patent
Loevenich

(10) Patent No.: US 9,623,989 B2
(45) Date of Patent: Apr. 18, 2017

(54) METHOD AND APPARATUS FOR BUNDLING PACKAGES OF ABSORBENT ARTICLES

(71) Applicant: The Procter & Gamble Company, Cincinnati, OH (US)

(72) Inventor: Franz Loevenich, Mechernich (DE)

(73) Assignee: The Procter & Gamble Company, Cincinnati, OH (US)

( * ) Notice: Subject to any disclaimer, the term of this patent is extended or adjusted under 35 U.S.C. 154(b) by 760 days.

(21) Appl. No.: 13/781,805

(22) Filed: Mar. 1, 2013

(65) Prior Publication Data

US 2014/0245701 A1 Sep. 4, 2014

(51) Int. Cl.
*B65B 5/06* (2006.01)
*B65B 41/16* (2006.01)
(Continued)

(52) U.S. Cl.
CPC ..... *B65B 5/06* (2013.01); *B65B 9/026* (2013.01); *B65B 41/16* (2013.01); *B65B 51/303* (2013.01);
(Continued)

(58) Field of Classification Search
CPC ..... B65B 51/303; B65B 11/18; B65B 11/26; B65B 13/20; B65B 25/146; B65B 27/125
See application file for complete search history.

(56) References Cited

U.S. PATENT DOCUMENTS 3,748,811 A * 7/1973 Cox ..... B65B 9/026 156/311
3,994,116 A * 11/1976 McCormick ..... B65B 9/026 53/228
(Continued)

FOREIGN PATENT DOCUMENTS

CN 200945943 9/2007
EP 1 566 377 A1 8/2005
(Continued)

OTHER PUBLICATIONS

PCT International Search Report PCT/US2014/018311, dated May 19, 2014. 10 pages.

*Primary Examiner* — Hemant M Desai
*Assistant Examiner* — Mobeen Ahmed
(74) *Attorney, Agent, or Firm* — Sarah M. DeCristofaro; Abbey A. Lopez

(57) ABSTRACT

A method of bundling primary packages of absorbent articles into secondary packages includes advancing first and second films in a stretched state in a machine direction. At least two primary packages of absorbent articles are advanced in the machine direction between the first and second films. The primary packages are compressed in a first direction, wherein the first direction is orthogonal to the machine direction. The primary packages are advanced in a second direction, wherein the second direction is opposite the machine direction. The first and second films are bonded together to form a bonded region. The first and second films compress the primary packages of absorbent articles in the
(Continued)

first direction, forming a secondary package around the primary packages of absorbent articles. The bonded region is cut to form a first bond on a first secondary package and a second bond on a second secondary package.

8 Claims, 7 Drawing Sheets

(51) Int. Cl.

| | |
|---|---|
| ***B65B 51/30*** | (2006.01) |
| ***B65B 57/04*** | (2006.01) |
| ***B65B 63/02*** | (2006.01) |
| ***B65B 9/02*** | (2006.01) |
| *B65B 13/20* | (2006.01) |
| *B65B 25/14* | (2006.01) |
| *B65B 11/26* | (2006.01) |
| *B65B 27/12* | (2006.01) |
| *B65B 11/18* | (2006.01) |

(52) U.S. Cl.
CPC ..... *B65B 57/04* (2013.01); *B65B 63/02* (2013.01); *B65B 11/18* (2013.01); *B65B 11/26* (2013.01); *B65B 13/20* (2013.01); *B65B 25/146* (2013.01); *B65B 27/125* (2013.01); *B65B 2220/20* (2013.01)

(56) References Cited

U.S. PATENT DOCUMENTS 4,377,061 A * 3/1983 Olson ..... B65B 9/02 53/433
4,413,463 A * 11/1983 Lancaster ..... B65B 9/026 53/228
4,738,078 A * 4/1988 Benz ..... B65B 11/10 53/228
4,858,416 A * 8/1989 Monaghan ..... B65B 9/02 53/373.5
4,864,803 A * 9/1989 Bohrmann ..... B65B 63/02 53/527
4,909,388 A * 3/1990 Watanabe ..... B65B 25/146 206/390
4,914,892 A * 4/1990 Saito ..... B65B 53/00 53/229
5,022,216 A * 6/1991 Muckenfuhs ..... B65B 63/02 100/151
5,150,561 A * 9/1992 Muckenfuhs ..... A61F 15/001 53/412
5,187,922 A * 2/1993 Mast ..... B65B 9/026 53/229
5,255,495 A * 10/1993 Kovacs ..... B65B 9/067 53/504
5,964,970 A * 10/1999 Woolwine ..... A61F 13/15772 156/229
5,971,153 A * 10/1999 Bauer ..... A61F 13/5511 206/494
5,979,145 A * 11/1999 Louis ..... B65B 63/022 100/151
6,026,957 A * 2/2000 Bauer ..... B65D 71/0085 206/494
8,464,502 B2 * 6/2013 Spiekers ..... B65B 9/067 53/530
2002/0007617 A1 * 1/2002 Hannen ..... B65B 9/026 53/466
2002/0059785 A1 * 5/2002 Gamberini ..... B65B 25/146 53/543
2002/0073649 A1 * 6/2002 Gamberini ..... B65B 11/10 53/228
2002/0073655 A1 * 6/2002 Gamberini ..... B65B 11/10 53/438
2003/0115837 A1 * 6/2003 Zimmer ..... B65D 33/1691 53/436
2004/0020169 A1 * 2/2004 Haasl ..... B65B 25/146 53/450
2004/0139701 A1 * 7/2004 Cady ..... B29C 65/18 53/434
2006/0130431 A1 * 6/2006 Baggot ..... B65B 63/02 53/439
2009/0120045 A1 * 5/2009 Gorrieri ..... B65B 11/12 53/543

FOREIGN PATENT DOCUMENTS

| | | |
|---|---|---|
| EP | 611013 | 6/2011 |
| JP | S59-218127 | 12/1984 |
| JP | H 11-506998 | 6/1999 |
| WO | WO 2008/009456 A1 | 1/2008 |

* cited by examiner

METHOD AND APPARATUS FOR BUNDLING PACKAGES OF ABSORBENT ARTICLES

FIELD OF THE INVENTION

The present disclosure relates to methods and apparatuses for packaging absorbent articles, and more particularly, to methods and apparatuses for bundling packages of absorbent articles.

BACKGROUND OF THE INVENTION

In some processes, fully assembled absorbent articles are packaged and stacked on a pallet for shipment and distribution to customers. Typically, the absorbent articles are packaged in primary packaging, such as polybags, which are then placed into secondary packaging, such as cardboard containers or poly overwrap. The manufacturer may provide printed indicia on either or both the primary packaging and the secondary packaging, depending on which is intended to be the product ultimately purchased by a consumer. For example, sometimes, a plurality of primary packages of absorbent articles may be bundled together in a secondary package and stacked on a pallet for shipment to a retailer. The secondary package may be a poly overwrap. Once the pallet reaches the retailer, the retailer may remove a secondary package from the stack, remove the primary packages from the secondary package, and place the individual polybags of absorbent articles on the shelf for consumers to purchase. Alternately, a secondary package may be removed from the pallet and placed directly on the shelf with the polybag overwrap, then a consumer purchases the secondary package, takes it home, and opens the polybag overwrap and disposes of it.

Some absorbent articles may have relatively low levels of pulp or no pulp at all. Such absorbent articles may be relatively thin compared to an absorbent article containing higher levels of pulp. However, packages of absorbent articles having little to no pulp may have a low resistance to deformation. As a result, when packages of such absorbent articles are stacked on a pallet, the packages near the top of the stack apply pressure to the packages near the bottom of the stack, causing the absorbent articles positioned near the bottom of the pallet to deform. If the absorbent articles deform, the stacks of packages may lean and possibly fall off of the pallet during shipment and/or storage of the pallets.

Sometimes, in order to prevent the packages of absorbent articles from leaning and falling off of the pallet, the packages may be packaged into cardboard boxes. In other instances, cardboard separators may be placed between adjacent packages to provide additional support to the lower packages in the stack. In some instances, the stacks of packages may be wrapped with a thin thermoplastic film to hold the packages of absorbent articles on the pallet. However, the additional cardboard boxes, cardboard separators, and thermoplastic film may add cost and complexity to the packaging process.

Thus, it would be beneficial to provide a method and apparatus for packaging absorbent articles having relatively low levels of pulp or no pulp at all such that the absorbent articles are capable of resisting deformation. Also, it would be beneficial to provide a method for stacking bundles of absorbent articles on a pallet for stable shipment of the bundles.

SUMMARY OF THE INVENTION

Aspects of the present disclosure include a method of bundling primary packages of absorbent articles into secondary packages, the method comprising the steps of: advancing a first continuous length of film in a machine direction to a first metering device at a speed, V1; advancing the first continuous length of film in the machine direction to a first moving surface at a speed, V2, wherein the V2 is greater than V1, wherein the first continuous length of film stretches between the first metering device and the first moving surface; advancing a second continuous length of film in the machine direction to a second metering device at speed, V1; advancing the second continuous length of film in the machine direction to a second moving surface at speed, V2, wherein the second continuous length of film stretches between the second metering device and the second moving surface; advancing at least two primary packages of absorbent articles in the machine direction between the first continuous length of film and the second continuous length of film, wherein the first continuous length of film is positioned between the primary packages of absorbent articles and the first moving surface, wherein the second continuous length of film is positioned between the primary packages of absorbent articles and the second moving surface, wherein the primary packages are compressed in a first direction, wherein the first direction is orthogonal to the machine direction; and bonding the first and second continuous lengths of film together to form a bonded region while maintaining the first and second continuous lengths of film in the stretched state, wherein the first and second continuous lengths of film form a secondary package surrounding the primary packages of absorbent articles.

Aspects of the present disclosure include a method of bundling primary packages of absorbent articles into secondary packages, the method comprising the steps of: advancing a first film in a stretched state in a machine direction; advancing a second film in a stretched state in the machine direction; advancing at least two primary packages of absorbent articles in the machine direction; compressing the primary packages in a first direction, wherein the first direction is orthogonal to the machine direction; advancing the primary packages in a second direction, wherein the second direction is opposite the machine direction; and bonding the first and second films to form a bonded region while maintaining the first and second films in the stretched state, wherein the first and second films compress the primary packages of absorbent articles in the machine direction, wherein the first and second films form a secondary package surrounding the primary packages of absorbent articles.

Aspects of the present disclosure include a method of stacking secondary packages of absorbent articles, the method comprising the steps of: advancing first and second primary packages of absorbent articles in a machine direction; compressing the first and second primary packages in a first direction with a force, F1, wherein the first direction is orthogonal to the machine direction; bundling the first and second primary packages into a first secondary package in the compressed state; advancing third and fourth primary packages of absorbent articles in the machine direction; compressing the third and fourth primary packages in the first direction with the force, F1; bundling the third and fourth primary packages into a second secondary package in the compressed state; and stacking the second secondary package on the first secondary package, wherein the second secondary package applies a force, F2 to the first secondary package in the second direction, wherein F2 is less than or equal to F1.

DETAILED DESCRIPTION OF THE INVENTION

Figure 1:
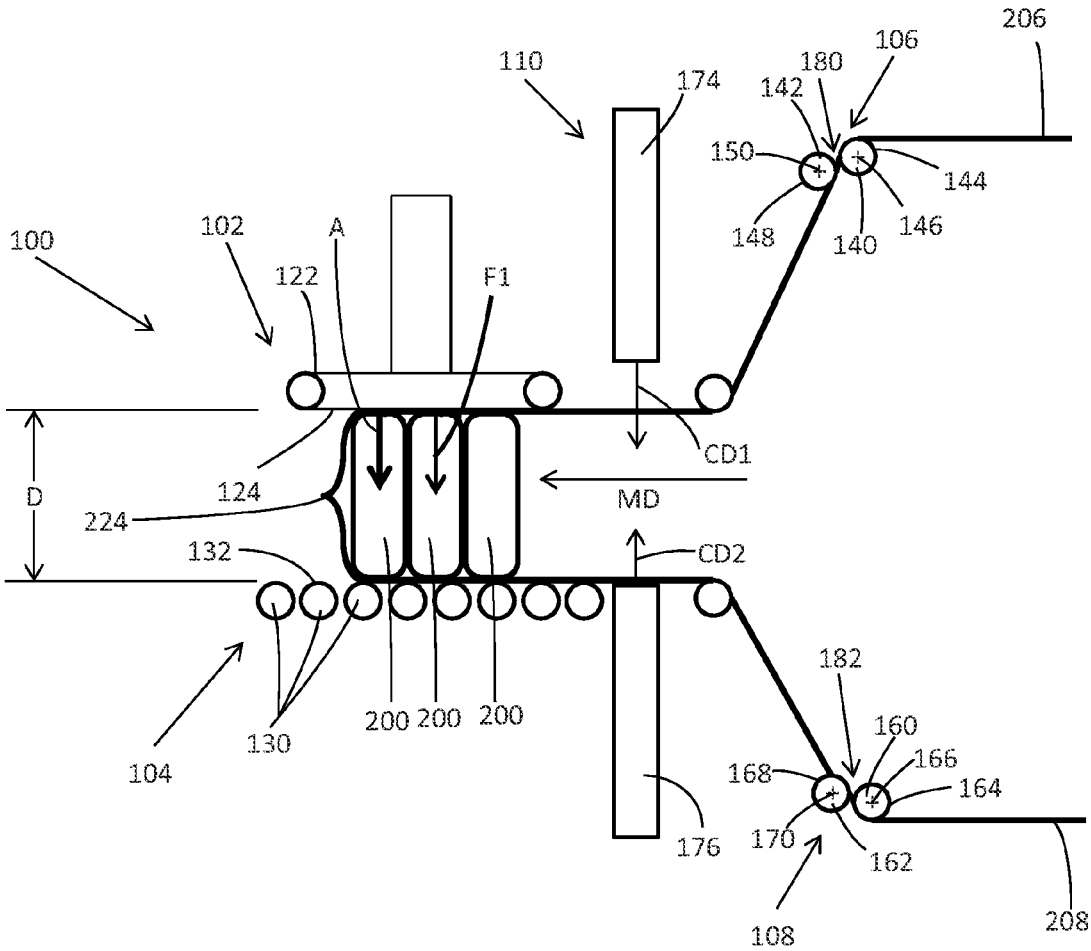
FIG. 1 is a schematic, side elevation view of a bundling apparatus.
Figure 2:
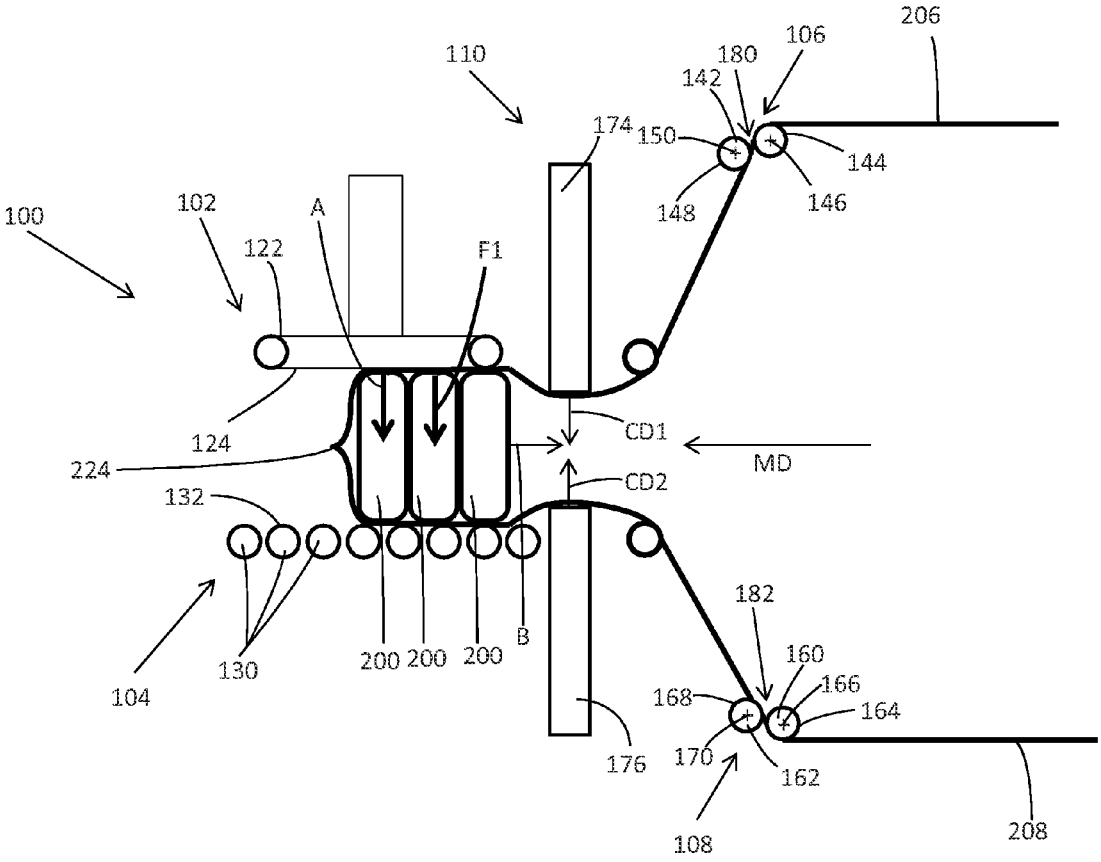
FIG. 2 is a schematic, side, elevation view of a bundling apparatus.
Figure 3:
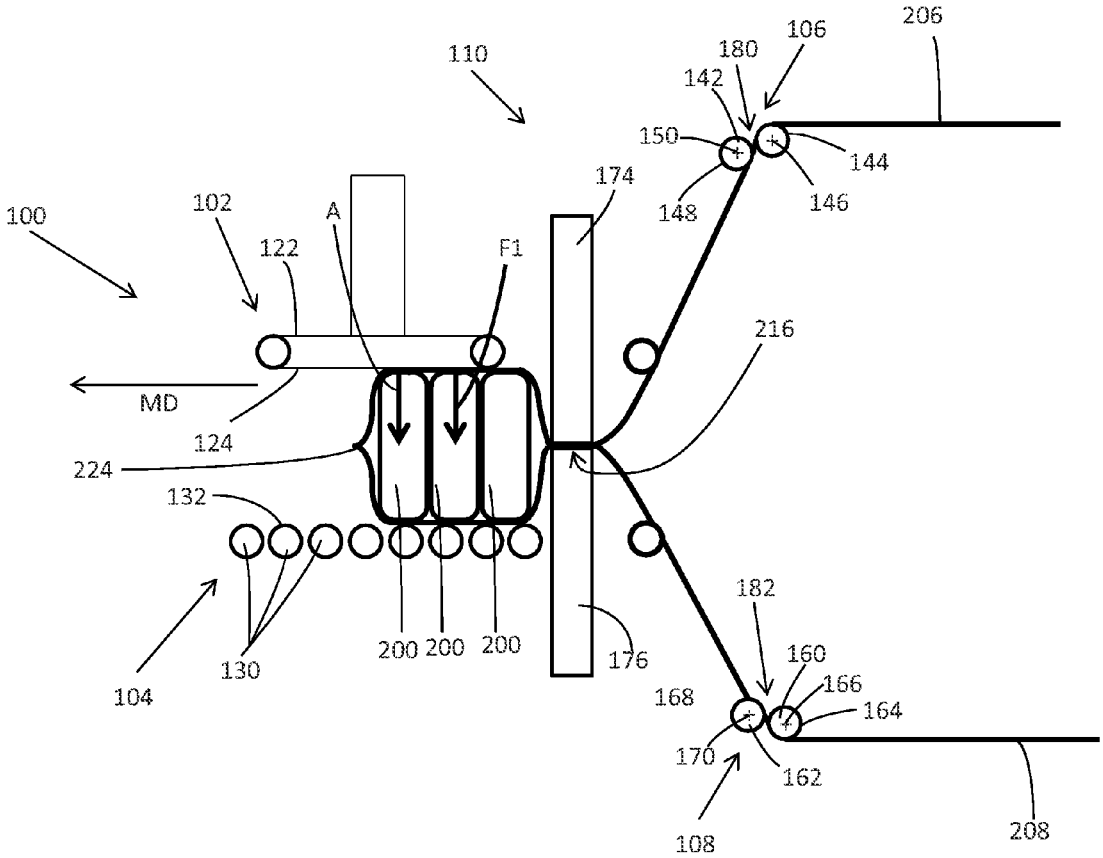
FIG. 3 is a schematic, side, elevation view of a bundling apparatus.

The following definitions may be useful in understanding the present disclosure.

"Absorbent article" is used herein to refer to consumer products whose primary function is to absorb and retain soils and wastes. Absorbent articles may include disposable diapers, pads, and the like. "Diaper" is used herein to refer to an absorbent article generally worn by infants and incontinent persons about the lower torso of the wearer.

"Machine direction" (MD) refers herein to the direction of material flow through a process. In addition, relative placement and movement of material can be described as flowing in the machine direction through a process from upstream in the process to downstream in the process.

"Cross direction" (CD) refers herein to a direction that is not parallel with, and usually perpendicular to, the machine direction.

"Film" refers to a sheet-like material wherein the length and width of the material far exceed the thickness of the material. Typically, films have a thickness of about 0.5 mm or less.

In the context of the present description, an elongation of 0% refers to a material in relaxed state having a relaxed length of L, and elongation of 150% represents 2.5× the relaxed length, L, of the material. For example, a film having a relaxed length of 100 millimeters would have a length of 250 millimeters at 150% elongation. And a film having a relaxed length of 100 millimeters would have a length of 180 millimeters at 80% elongation.

The present disclosures relates to methods and apparatuses for packaging absorbent articles, and more particularly, to methods and apparatuses for preparing packages of absorbent articles for shipment. The methods and apparatuses of the present disclosure include packaging primary packages of absorbent articles in secondary packages and subsequently stacking the secondary packages of absorbent articles on a pallet for shipment. The absorbent articles may be packaged in primary packaging, such as polybags, which are then placed into secondary packaging, such as a film overwrap.

While the present disclosure discusses packaging absorbent articles, it is to be appreciated that the methods and apparatuses of the present disclosure may be used to package various other consumer products, such as paper towel, toilet paper, cleaning products, cosmetics, pharmaceutical products, and the like.

In an exemplary configuration, first and second films may advance in a machine direction in a stretched state to a bundling apparatus. Primary packages of absorbent articles may advance in the machine direction to the bundling apparatus and may be compressed in a first direction. The first direction is orthogonal to the machine direction. Next, the primary packages may advance in a second direction, wherein the second direction is opposite the machine direction. The first and second films may be bonded together to form a bonded region while maintaining the first and second films in the stretched state. The first and second films compress the primary packages of absorbent articles in the machine direction. The first and second films form a secondary package surrounding the primary packages of absorbent articles. The bonded region may be cut to form a first bond on a first secondary package and a second bond on a subsequently advancing second secondary package.

An exemplary bundling apparatus may comprise a first carrier apparatus and a second carrier apparatus. The first carrier apparatus may comprise a first moving surface and the second carrier apparatus may comprise a second moving surface. The first moving surface may be in a face-to-face relationship with the second moving surface. The first moving surface may be located a minimum distance from the second moving surface. In addition, the bundling apparatus may comprise a first metering device and a second metering device. In operation, the first film may advance from the first metering device to the first moving surface of the first carrier apparatus. Likewise, the second film may advance from the second metering device to the second moving surface of the second carrier apparatus. The first film may be stretched between the first metering device and the first moving surface and the second film may be stretched between the second metering device and the second moving surface. The primary packages of absorbent articles may advance between the first and second films. The primary packages may advance to the bundling apparatus in an uncompressed state. The height of the uncompressed primary packages may be less than the minimum distance between the first moving surface and the second moving surface such that the first and second carrier apparatuses compress the primary packages in the first direction.

The bundling apparatus may comprise a welding apparatus. The welding apparatus may comprise a first welding member and a second welding member. The welding apparatus may be configured to bond the first and second films together to form bonded regions. Moreover, the welding apparatus may be configured to cut the bonded region to form a first bond on a first secondary package and a second bond on a second secondary package.

In an exemplary configuration, a plurality of secondary packages may be stacked on a pallet for shipment. First and second primary packages of absorbent articles may advance in a machine direction to a bundling apparatus. The first and second primary packages may be compressed in a first direction with a force, F1, and bundled into a first secondary package in the compressed state. Next, third and fourth primary packages of absorbent articles may advance in the machine direction to the bundling apparatus. The third and fourth primary packages may be compressed in the first direction with the force, F1, and bundled into a second secondary package in the compressed state. The first secondary package may be placed on a pallet. Subsequently, the second secondary package may be stacked on the first secondary package. The second secondary package may apply a force, F2, to the first secondary package in the first direction, wherein F2 is less than or equal to F1. As a result, the absorbent articles in the first secondary package are able to withstand the force applied by the second secondary package of absorbent articles. Additionally, the first and second secondary packages may apply a force, F3, to the first and second and third and fourth primary packages, respectively, in the machine direction. The force, F3, applied by the secondary packages to the primary packages assists in uniformly distributing the force, F2, that is applied to the first secondary package.

Referring to FIGS. 1-4, the bundling apparatus 100 includes a first metering device 106 and a second metering device 108. The first metering device 106 may include first and second rollers 140 and 142. The first roller 140 has an outer circumferential surface 144 and is rotatable about an axis of rotation 146. The second roller 142 has an outer circumferential surface 148 and is rotatable about an axis of rotation 150. The second roller 142 is positioned adjacent to the first roller 140, defining a nip 180 there between. The first roller 140 and the second roller 142 are configured to rotate in opposite directions. The first and second rollers 140 and 142 rotate such that the outer circumferential surfaces 144 and 148 move at a speed, V1. The second metering device 108 may also include first and second rollers 160 and 162. The first roller 160 has an outer circumferential surface 164 and is rotatable about an axis of rotation 166. The second roller 162 has an outer circumferential surface 168 and is rotatable about an axis of rotation 170. The second roller 162 is positioned adjacent to the first roller 160, defining a nip 182 there between. The first roller 160 and the second roller 162 are configured to rotate in opposite directions. The first and second rollers 160 and 162 rotate such that the outer circumferential surfaces 164 and 168 move at the speed, V1.

It is to be appreciated that various other apparatuses may be used for the metering devices. For example, the metering devices may include rollers, drums, conveyors, and combinations thereof. The metering devices may include one roller, drum, or conveyor. In some exemplary configurations, the first and second metering devices may include more than one roller, drum, conveyor, or combinations thereof.

As shown in FIGS. 1-4, a bundling apparatus 100 includes a first carrier apparatus 102 and a second carrier apparatus 104. The first carrier apparatus 102 includes a first moving surface 124 and the second carrier apparatus 104 includes a second moving surface 132. The first moving surface 124 may be in a face-to-face relationship with the second moving surface 132. The first moving surface 124 may be located a minimum distance, D, from the second moving surface 132. The first carrier apparatus 102 may include a belt 122 that forms the first moving surface 124. The second carrier apparatus 104 may include a plurality of rollers 130 that form the second moving surface 132. The first moving surface 124 may be configured to move at a speed, V2. The second moving surface may be configured to move at the speed, V2. V2 may be greater than V1. It is to be appreciated that the first and second moving surfaces 124 and 132 may be configured in various ways. For example, the first and/or second moving surfaces 124 and 132 may be configured as conveyors, rollers, or combinations thereof.

As shown in FIGS. 1-4, the bundling apparatus 100 may also include a welding device 110 having a first welding member 174 and a second welding member 176. The first and second welding members 174 and 176 are configured to concurrently move toward and away from each other in opposite directions, shown as a first cross direction CD1 and a second cross direction CD2. The first and second welding members 174 and 176 may be heated by a heat source. The first and second welding members 174 and 176 may also be configured with a cutting member.

As shown in FIGS. 1-4, in operation, a first continuous length of film 206 advances in a machine direction MD to the first metering device 106. Concurrently, a second continuous length of film 208 advances in the machine direction MD to the second metering device 108. The first and second rollers 140 and 142 of the first metering device 106 may be configured to advance the first continuous length of film 206 at the speed, V1. Similarly, the first and second rollers 160 and 162 of the second metering device 108 may be configured to advance the second continuous length of film 208 at the speed, V1. From the first metering device 106, the first continuous length of film 206 may advance onto the first moving surface 124 of the first carrier apparatus 102. The first moving surface 124 may advance the first continuous length of film 206 at the speed, V2. From the second metering device 108, the second continuous length of film 208 may advance onto the second moving surface 132 of the second carrier apparatus 104. The second moving surface 132 may advance the second continuous length of film 208 at the second speed, V2. As such, because the first continuous length of film 206 advances at the speed, V1, at the first metering device 106, and advances at the speed, V2, at the first carrier apparatus 102, wherein V2 is greater than V1, the first continuous length of film 206 stretches between the first metering device 106 and the first carrier apparatus 102. Similarly, because the second continuous length of film 208 advances at the speed, V1, at the second metering device 108, and advances at the speed, V2, at the second carrier apparatus 104, wherein V2 is greater than V1, the second continuous length of film 208 stretches between the second metering device 108 and the second carrier apparatus 104.

Figure 4:
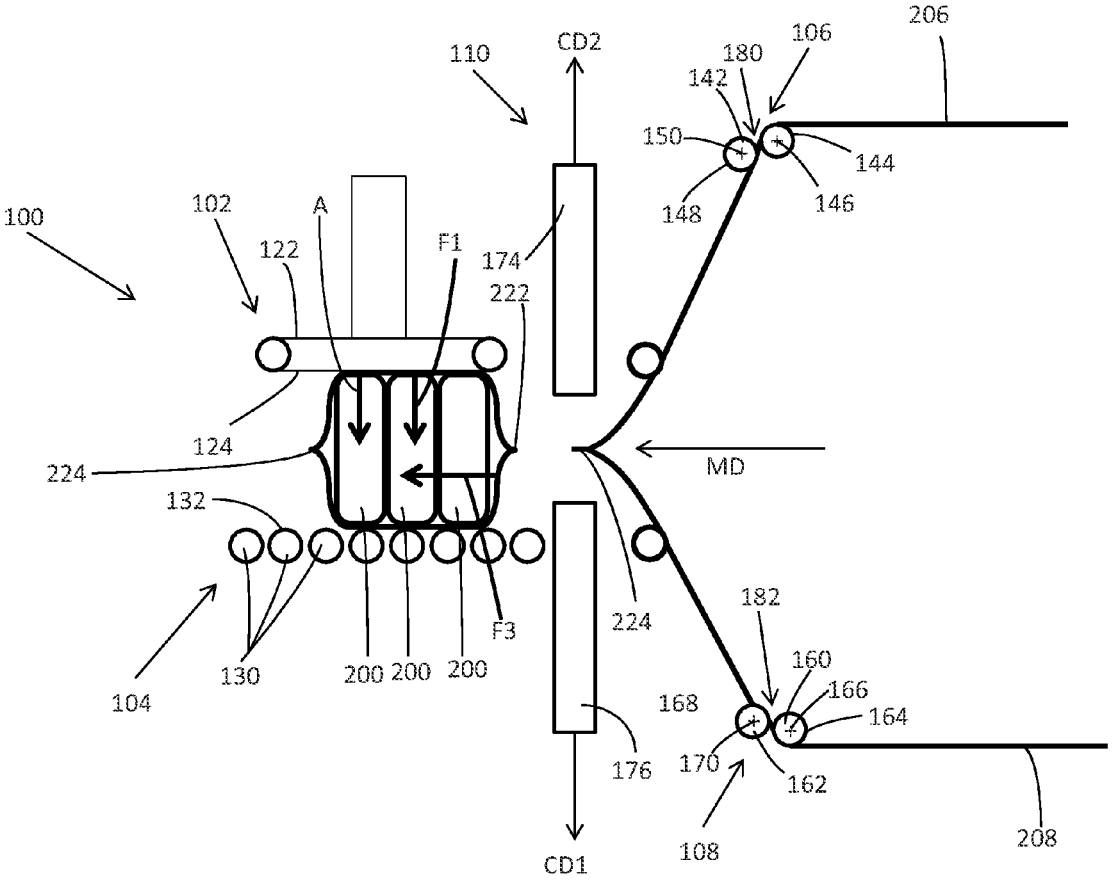
FIG. 4 is a schematic, side, elevation view of a bundling apparatus.
Figure 6:
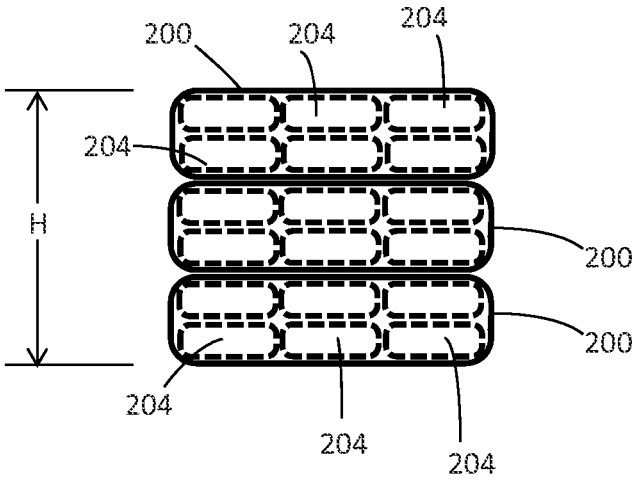
FIG. 6 is a schematic, side elevation view of primary packages containing absorbent articles.
Figure 5:
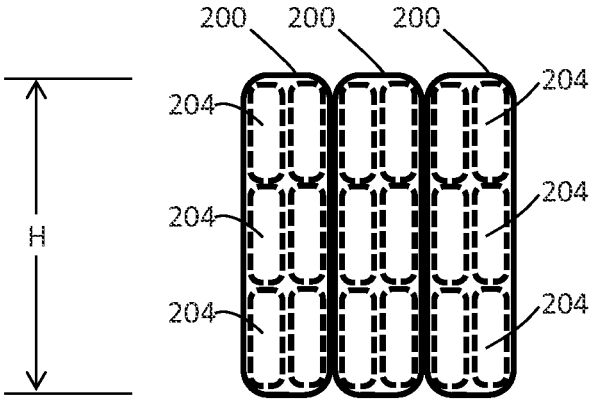
FIG. 5 is a schematic, side elevation view of primary packages containing absorbent articles.

Next, with continuing reference to FIGS. 1-4, at least two primary packages 200 of absorbent articles 204 advance in the machine direction MD to the bundling apparatus 100. As shown in FIGS. 5 and 6, the primary packages 200 may include a plurality of absorbent articles 204. The primary packages 200 have an uncompressed height, H, extending in a first direction, shown as direction, A. The primary packages 200 advance between the first moving surface 124 and the second moving surface 132. The first continuous length of film 206 advances between the first moving surface 124 and the primary packages 200 and the second continuous length of film 208 advances between the second moving surface 132 and the primary packages 200. In some exemplary configurations, the minimum distance, D, between the first moving surface 124 and the second moving surface 132 may be less than the uncompressed height, H, of the primary packages 200. As a result, the first and second carrier apparatuses 102 and 104 apply a compressive force, shown as F1 in FIGS. 1-4, to the primary packages 200 in direction, A. It is to be appreciated that the first continuous length of film 206 and the second continuous length of film 208 may be bonded together, shown as a second bond 224 in FIGS. 1-4, downstream of the primary packages 200 prior to the plurality of primary packages 200 advancing to the bundling apparatus 100. The primary packages 200 may advance to the bundling apparatus 100 until the primary packages 200 are located adjacent to the second bond 224. Once the plurality of primary packages 200 advance adjacent to the second bond 224 of the first and second continuous length of film 206 and 208, the first and second continuous lengths of film 206 and 208 may be bonded together at a bonded region 216 using the welding apparatus 110.

In the bonding process, the first and second welding members 174 and 176 move in the first cross direction CD1 and the second cross direction CD2 toward each other and toward the first and second continuous lengths of film 206 and 208. Concurrently, the primary packages 200 advance in a second direction, shown in FIG. 2 as direction, B, toward the welding apparatus 100. It is to be appreciated that moving the primary packages in the direction, B, toward the welding apparatus 110 as the first and second welding members 174 and 176 move in the first and second cross directions CD1 and CD2, the first and second continuous lengths of film 206 and 208 are maintained in a stretched state with a substantially constant tension. The first and second welding members 174 and 176 apply pressure and/or heat to the first and second continuous lengths of film 206 and 208 to form the bonded region 216 in the first and second continuous lengths of film 206 and 208. Once the bonded region 216 is formed, the first and second welding members 174 and 176 may cut the bonded region 216, forming a first bond 222 connected with a secondary package 202 and a second bond 224 for a subsequent secondary package. The secondary package 202 containing the primary packages 200 may advance in the machine direction MD, away from the bundling apparatus 100. The bundling apparatus 100 may, in turn, prepare for bundling subsequently advancing primary packages 200. As shown in FIG. 4, the second bond 224 joining the first and second continuous lengths of film 206 and 208 is ready for subsequent primary packages 200 to advance in the machine direction MD to the bundling apparatus 100.

Figure 7:
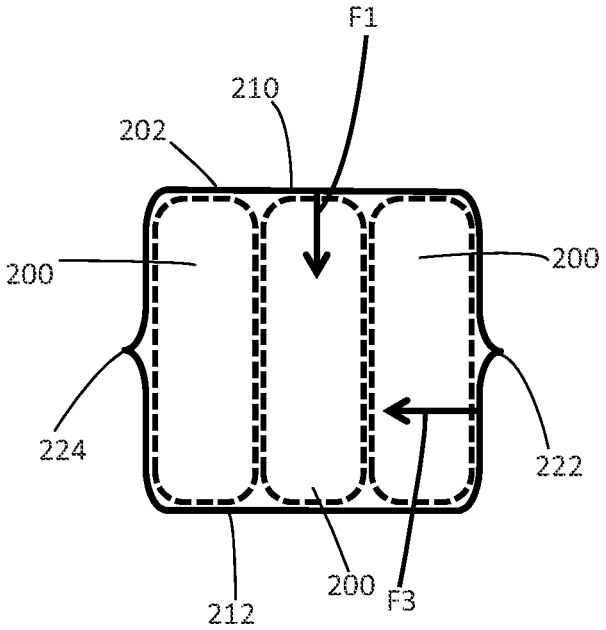
FIG. 7 is a schematic, side elevation view of a secondary package containing primary packages of absorbent articles.
Figure 8:
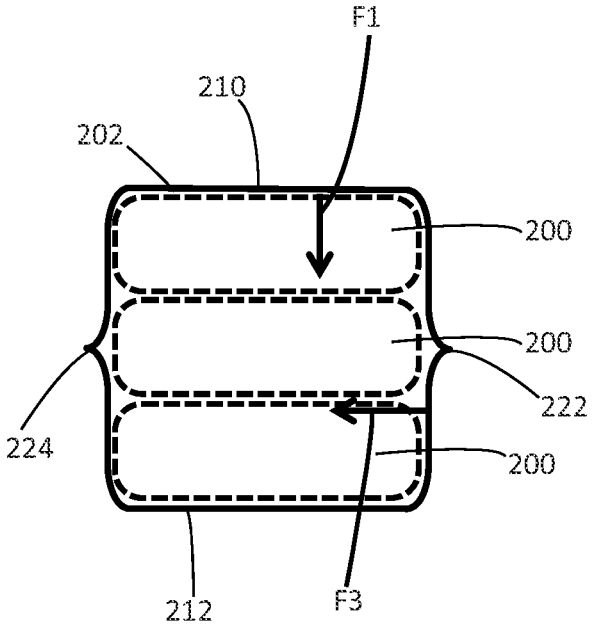
FIG. 8 is a schematic, side elevation view of a secondary package containing primary packages of absorbent articles.

As shown in FIGS. 4, 7, and 8, the secondary package 202 may include a first discrete length of film 210 and a second discrete length of film 212. As a result of joining the first and second continuous lengths of film 206 and 208 in a stretched state around the primary packages 200, the first and second discrete lengths of film 210 and 212 apply a compressive force, shown F3 in FIGS. 4, 7, and 8, to the primary packages in the machine direction MD.

The first continuous length of film 206 may be stretched to various elongations between the first metering device and the first moving surface of the first carrier apparatus. Additionally, the second continuous length of film 208 may be stretched to various elongations between the second metering device and the second moving surface of the second carrier apparatus. For example, the first and second continuous lengths of film may be stretched to an elongation of greater than about 110%, greater than about 120%, greater than about 130%, greater than about 140%, greater than about 150%, or greater than about 200%. The first continuous length of film may be stretched to a first elongation and the second continuous length of film may be stretched to a second elongation. The first elongation and the second elongation may be the same. Or, in some exemplary configurations, the first and second elongations may be different. It is to be appreciated that the greater the elongation, the greater the compressive force, F3, that is applied to the primary packages in the machine direction MD. In some exemplary configurations, the compressive force, F3, may be greater than about 5 Newtons, greater than about 10 Newtons, greater than about 15 Newtons, greater than about 20 Newtons, greater than about 25 Newtons, greater than about 30 Newtons, greater than about 35 Newtons, or greater than about 40 Newtons.

Various compressive forces may be applied to the primary packages 200 of absorbent articles 204. In some exemplary configurations, the compressive force, F1, may be greater than about 5 Newtons, greater than about 10 Newtons, greater than about 15 Newtons, greater than about 20 Newtons, greater than about 25 Newtons, greater than about 30 Newtons, greater than about 35 Newtons, or greater than about 40 Newtons. It is to be appreciated that the smaller the minimum distance, D, between the first moving surface 124 and the second moving surface 32, the greater the compressive force, F1, applied to the primary packages 200 in direction, A.

Figure 9:
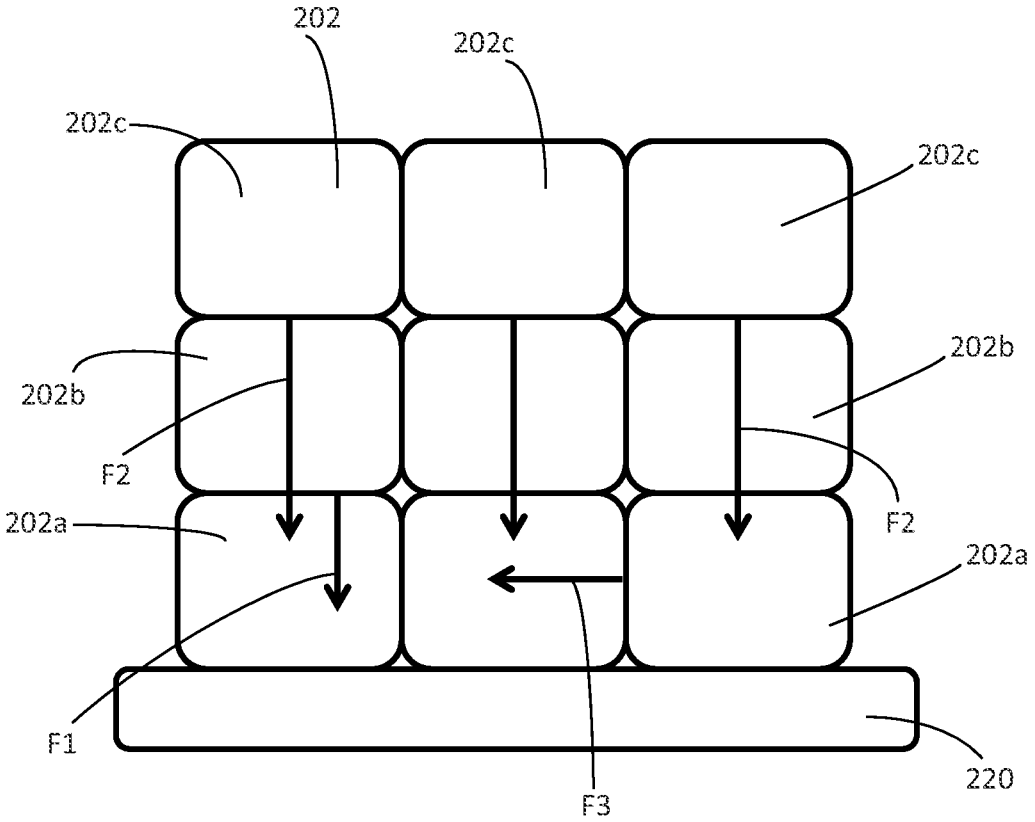
FIG. 9 is a schematic, side elevation view of a plurality of secondary packages of absorbent articles stacked on a pallet.

As shown in FIG. 9, a plurality of secondary packages 202 may be stacked on top of each other on a pallet 220. For example, at least three secondary packages 202 may be stacked one on top of the other. A first secondary package **202*a* may be located at the bottom of a stack, nearest to the pallet 220. Second and third secondary packages 202*b* and 202*c* may be stacked on top of the first secondary package 202*a*. The second and third secondary packages 202*b* and 202*c* apply a compressive force, shown as F2 in FIG. 9, on the first secondary package 202*a*. The compressive force, F3, applied to the first secondary package may be about 5 Newtons, about 10 Newtons, about 15 Newtons, about 20 Newtons, about 25 Newtons, about 30 Newtons, or about 35 Newtons. As such, the compressive force, F2, may be less than or equal to the compressive force, F1, that the primary packages 200 of absorbent articles 204 are compressed by the first and second moving surfaces 124 and 132. It is to be appreciated that the compressive force, F3, helps to evenly distribute the compressive force, F2, applied to the first secondary package 202*a* by the second and third secondary packages 202*b* and 202*c*. Furthermore, it is to be appreciated that various numbers of secondary packages 202 may be stacked on top of each other on the pallet 220**.

It is to be appreciated that various welding processes and apparatuses may be used to form the bonded regions in the first and second films. Exemplary welding processes include hot gas welding, contact or impulse welding, high frequency welding, or ultrasound welding.

Various films may be used for the first and second continuous lengths of film. For example, the film may be made of polyethylene, polypropylene, and the like. Exemplary polyethylene films are manufactured by Mondi Halle GmbH of Germany and Elif Plastik of Istanbul, Turkey.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of bundling primary packages of absorbent articles into secondary packages, the method comprising the steps of:

advancing a first continuous length of film in a machine direction to a first metering device at a speed, V1;

advancing the first continuous length of film in the machine direction to a first moving surface at a speed, V2, wherein the V2 is greater than V1, wherein the first continuous length of film stretches between the first metering device and the first moving surface;

advancing a second continuous length of film in the machine direction to a second metering device at speed, V1;

advancing the second continuous length of film in the machine direction to a second moving surface at speed, V2, wherein the second continuous length of film stretches between the second metering device and the second moving surface;

advancing at least two primary packages of absorbent articles in the machine direction between the first continuous length of film and the second continuous length of film, wherein the first continuous length of film is positioned between the primary packages of absorbent articles and the first moving surface, wherein the second continuous length of film is positioned between the primary packages of absorbent articles and the second moving surface, wherein portions of the first continuous length of film and the second continuous length of film extend beyond the primary packages of absorbent articles, and wherein the primary packages are compressed in a first direction, wherein the first direction is orthogonal to the machine direction;

advancing the at least two primary packages of absorbent article in a second direction while the portions the first continuous length of film and the second continuous length of film that extend beyond the primary packages of absorbent articles are moved towards one another for bonding, wherein the second direction is opposite the machine direction; and bonding the first and second continuous lengths of film together to form a bonded region while maintaining the first and second continuous lengths of film in the stretched state, wherein the first and second continuous lengths of film form a secondary package surrounding the primary packages of absorbent articles.

2. The method of claim 1 further comprising the step of cutting the bonded region of the first and second continuous lengths of film to form a first bond on a first secondary package and a second bond on a second secondary package.

3. The method of claim 1, wherein the step of bonding the first and second continuous lengths of film together to form the bonded region comprises welding the first and second continuous lengths of film to form the bonded region.

4. The method of claim 1, wherein the step of bonding the first and second continuous lengths of film to form the bonded region further comprises maintaining a substantially constant tension in the first and second continuous lengths of film.

5. The method of claim 1, wherein the step of advancing the first continuous length of film in the machine direction to the first moving surface at the speed, V2, further comprises the step of stretching the first continuous length of film to an elongation of greater than about 110%, wherein the step of advancing the second continuous length of film in the machine direction to the second moving surface at the speed, V2, further comprises the step of stretching the second continuous length of film to an elongation of greater than about 110%.

6. The method of claim 1, wherein the step of bonding the first and second continuous lengths of film together to form the bonded region while maintaining the first and second continuous lengths of film in a stretched state further comprises the step of compressing the primary packages in the machine direction.

7. The method of claim 6, wherein the primary packages are compressed in the machine direction at a force of greater than about 5 Newtons.

8. The method of claim 1, wherein the step of advancing the at least two primary packages of absorbent articles in the machine direction between the first continuous length of film and the second continuous length of film further comprises the step of compressing the primary packages in the first direction at a force of greater than about 20 Newtons.

* * * * *